United States Patent [19]

Caffa et al.

[11] 4,192,109

[45] Mar. 11, 1980

[54] COMPONENTS OF RETRACTABLE BEAMS, AND ASSEMBLIES THEREOF

[76] Inventors: Angelo Caffa; Letizia Caffa; Carla Caffa, all of Corso Francia 30, Turin, Italy

[21] Appl. No.: 870,831

[22] Filed: Jan. 19, 1978

[30] Foreign Application Priority Data

Jan. 26, 1977 [IT] Italy ..... 19642 A/77

[51] Int. Cl.[2] ..... E04B 1/346

[52] U.S. Cl. ..... 52/108; 52/632; 52/64; 52/81

[58] Field of Search ..... 52/64, 81, 741, 108, 52/632; 160/241

[56] References Cited

U.S. PATENT DOCUMENTS

| | | | |
|---|---|---|---|
| 2,948,047 | 8/1960 | Peeler et al. | 52/81 |
| 3,057,119 | 10/1962 | Kessler | 52/63 |
| 3,398,491 | 8/1968 | Babcock | 52/741 |
| 3,450,186 | 6/1969 | Caffa et al. | 160/241 |
| 3,530,622 | 9/1970 | Cohen | 52/741 |
| 4,027,440 | 6/1977 | Hamblin | 52/108 |

*Primary Examiner*—James L. Ridgill, Jr.
*Attorney, Agent, or Firm*—McGlew and Tuttle

[57] ABSTRACT

Components of retractable beams and assemblies thereof in which the interlocking members of each component, which are primary elements in the composition of the beams, have an elastic capacity which is controlled by the restraining members which form closing knots for the interlocking assembly. Many applications utilizing said components and assemblies are described.

3 Claims, 24 Drawing Figures

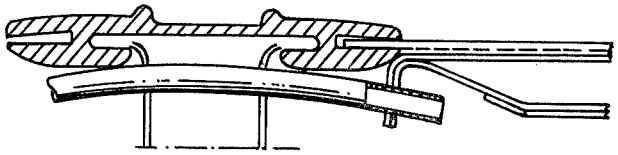
FIG. 1A
(PRIOR ART)
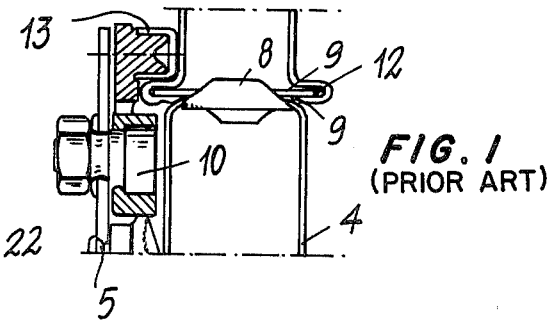
FIG. 1
(PRIOR ART)
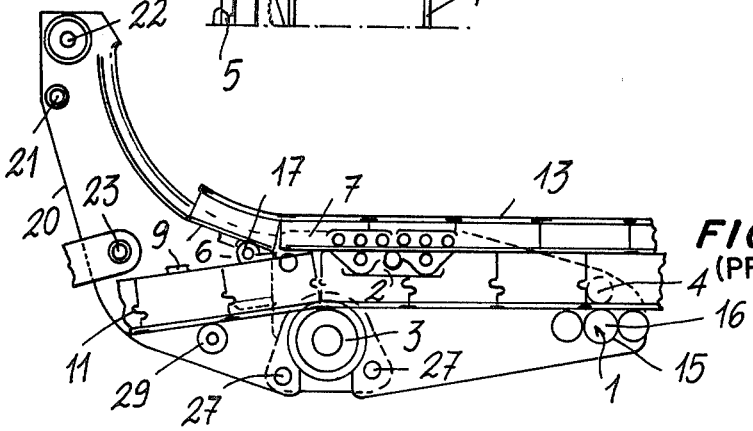
FIG. 2
(PRIOR ART)
FIG. 3
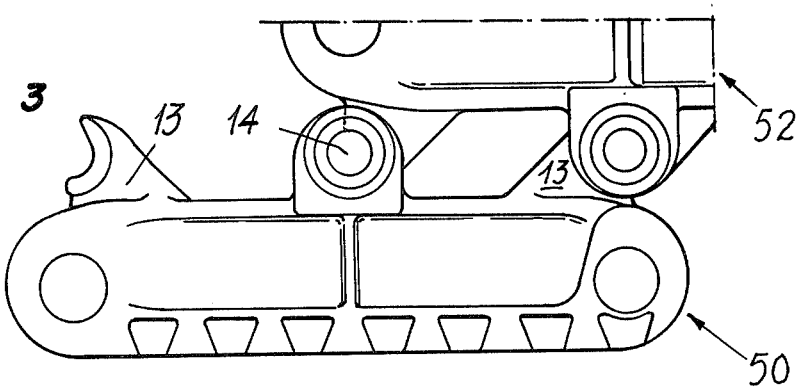
FIG. 4
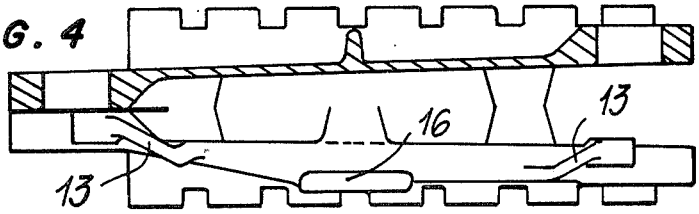

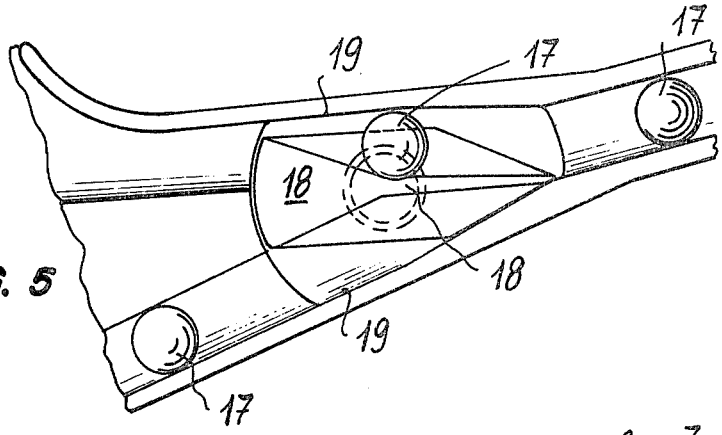
FIG. 5
FIG. 6
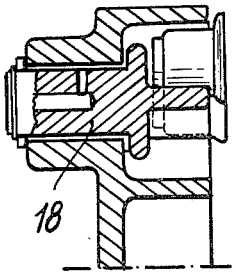
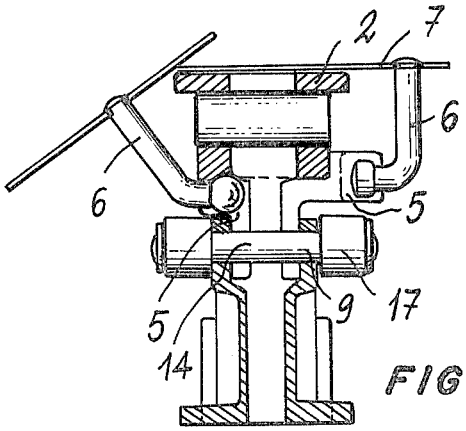
FIG. 7
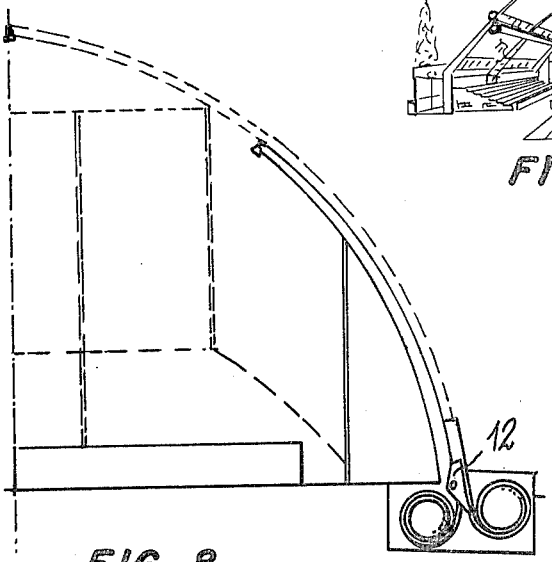
FIG. 8
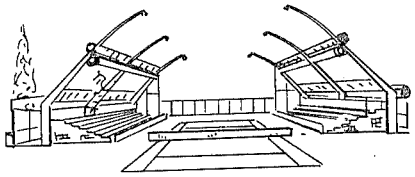
FIG. 9
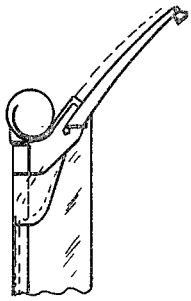
FIG. 10

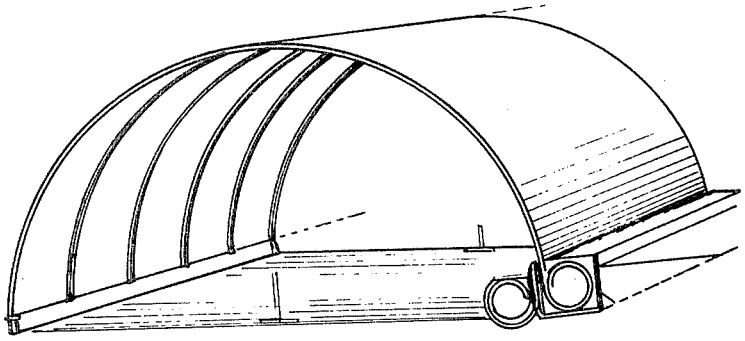
FIG. 11
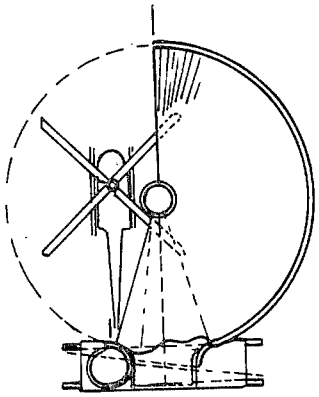
FIG. 13
FIG. 12
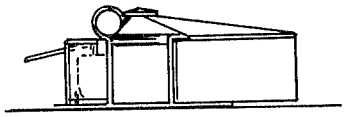
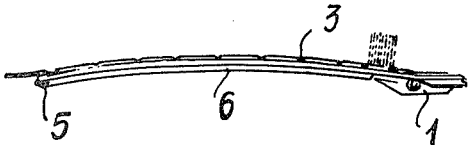
FIG. 14
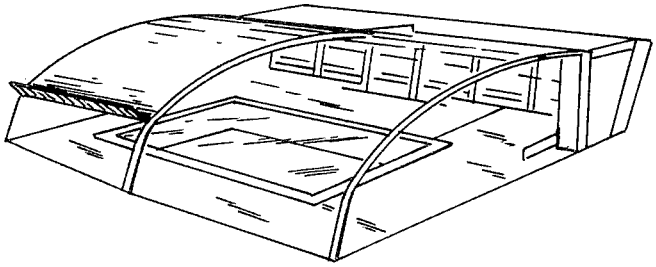
FIG. 15

FIG. 16
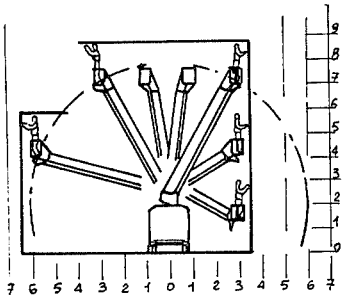
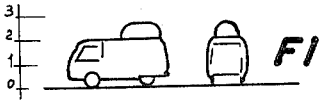
FIG. 18
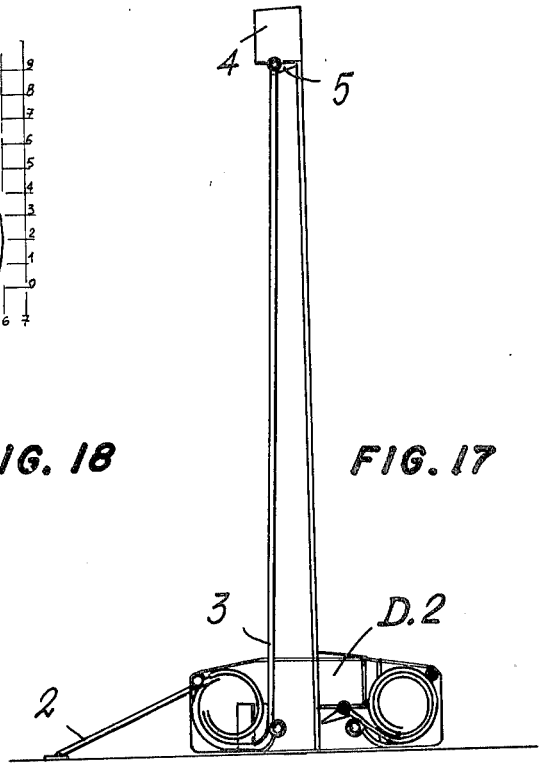
FIG. 17
FIG. 19
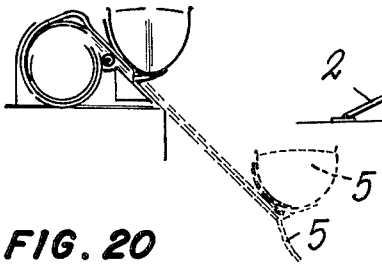
FIG. 20
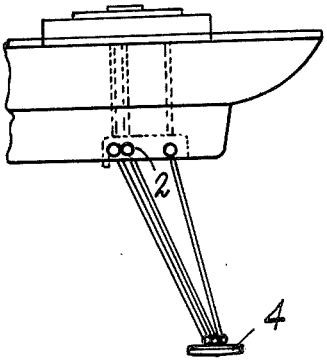
FIG. 21
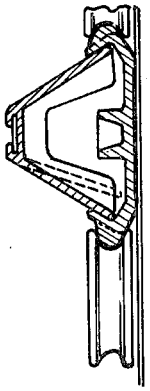
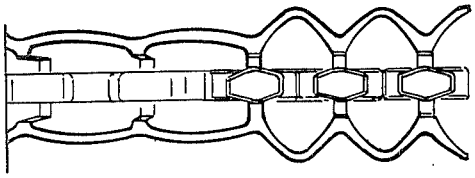
FIG. 23
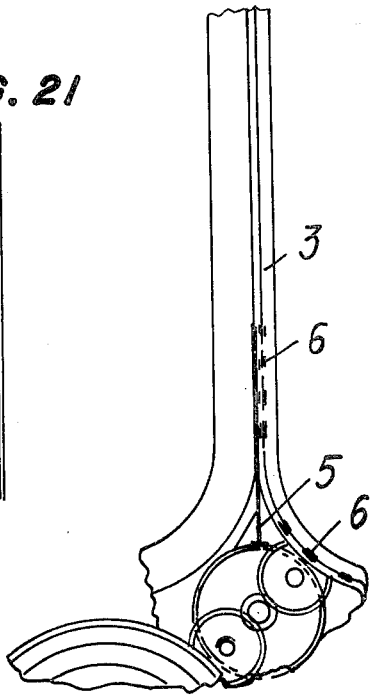
FIG. 22

COMPONENTS OF RETRACTABLE BEAMS, AND ASSEMBLIES THEREOF

FIELD AND BACKGROUND OF THE INVENTION

The present invention relates to components of retractable beams, assemblies thereof, and related applications.

CROSS REFERENCE TO RELATED PATENTS

In applicant's U.S. Pat. No. 3,450,186, which is incorporated herewith by reference, there was disclosed and claimed an assembly of interconnected elements which, when opposed, have with respect to each other a capacity to connect each other through structural knots of the meshed beams. This capacity becomes operational by the insertion of the assembly into a support box furnished with translational means.

BRIEF SUMMARY OF THE INVENTION

The present invention comprises components for a retractable beam and the assembled beam itself. The assembled beam can be used in a variety of structures where its retractable characteristics can be favorable utilized. Examples of this are the removable coverings of tennis courts and swimming pools, in extendable and retractable tower structures, and for extending and retracting machinery on a support where the support must be variable in length and still be rigid and beam-like in its character.

The retractable beam comprises a pair of beam chains each comprising a plurality of pivotally connected components. Each component on one beam chain includes means for forming an interlocking joint with a complementary component on the other of the beam chain pair. Means are provided for guiding the two beam chains into juxtaposition with each other so that the interlocking joint means on opposite components can interengage forming a single retractable beam assembly.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 1 is a detailed side partial view of a retractable beam in the beam forming means according to the prior art in U.S. Pat. No. 3,450,186;

FIG. 1*a* is a detail of an upper portion of the structure of FIG. 1;

FIG. 2 is a side elevational view of the prior art structure for forming a retractable beam of two beam chains according to U.S. Pat. No. 3,450,186 previously mentioned;

FIG. 3 is a side elevational view of a single component of one embodiment of the beam chain according to this invention, connected to a portion of a component of a complementary beam chain;

FIG. 4 is a top plan view of the component shown in FIG. 3 with portions cut away;

FIG. 5 is a side elevational view of a guide means and portion of the interlocking means for connecting two beam chains;

FIG. 6 is a cross-sectional view of the embodiment shown in FIG. 5;

FIG. 7 is a detailed cross-sectional view of the embodiment shown in FIG. 5;

FIG. 8 is a schematic elevational view of one use for a retractable beam;

FIGS. 9 through 23 are figures similar to FIG. 8 of other embodiments utilizing the inventive retractable beam.

FIGS. 1 and 2, there are indicated details of a sheet steel beam similar to that of U.S. Pat. No. 3,450,186 and of the relative support box. Trolleys 1 and 2 with reel 3 and roller 4 form a mobile joint between components. Rollers and the assembling and disassembling guides; are shown at 5 and 6 the eccentric pin 10 for the regulation of the upper trolley 2; 7 shows the point where the knots or nodes are formed. 8 indicates the section of the knot of ovoidal form, the decreasing peripherical rigidity thereof, taken together with the elastic deformability of cavities 9, permits the pressure closure determining the tension desired on the runners. 11 indicates the lateral joints of alignment and anticutting of the components.

FIG. 1A shows the constructive elements of paneling for greenhouses and light-weight structures which refer both to the concept of mechanical assembly to the beam and to the concept of sealing. Constructive details, of assemblage and the like, are apparent from the drawing.

FIGS. 3 and 4 illustrate in a non limitative manner the interlocking joints of retractable beam element that form a pair of beams according to the invention, realized in an embodiment preferred for medium and large applications.

A lower element 50 comprises one chain link or element of one first beam chain in a fashion similar to that shown in U.S. Pat. No. 3,450,186, and an upper element 52 (shown in part, only) comprises one chain link of a second beam chain. The relationship of the two chains is the same as that shown in FIG. 2 and in the mentioned patent.

FIG. 4 shows two forgings projection-welded on calibrating jig one in which, sectioned on the juncture line which constitutes the mesh, is the base element or components.

13 indicates jaws, with a resistant off-center section of limited elasticity, which pressure-close and form knots or engages on pin 14 fixed through fork 16 and having keyed thereon rollers 17, shown in FIG. 7.

FIGS. 5 and 6 show, by way of non-limiting example, one of the two pressure assembly and disassembly devices of the beam located on the sides of the support boxes. With 17 there are indicated the rollers keyed on the pins forming the knots. 18 is the disassembling oscillating pin; with 19 being the external assembling guides which bring under compression the jaws of the knots under compression and bring the runners of the beam under corresponding tension.

One of the characteristics of the retractable beam is the only partial constraint of a beam half as it refers to the restrained joint in the support box; a particular which permits the direct fastening of panelling varying from translucid panels to steel staves and other utilities which, with the contraction, accumulate beyond the joint itself, with the beam halves uncoupled.

In FIG. 7, 5 and 6 are cavities and third elements respectively, the third element 2 being insertible in same into the chamber in the phase of constraining panels, staves or other bodies for various utility processes of coordinated functionality. The rollers are keyed on the pins 17 of the chain in the case of a guided covering.

FIG. 8 shows in section an assembly of beams and panels which emerges in a curved fashion from the container located underground up to the point where it joins an opposite wall, forming a covering for a tennis field. FIG. 9 shows composite assemblies anchored in a step-wise manner. FIG. 10 shows a side view of a covering for a field made of the half beams on support poles.

In FIG. 11, there is schematically shown a covering the tub-shaped container of which is movable. The beams which operate supported by a rigid runner which is restrained at the extremity to compass trussing functioning as anti-tilt struts during the maneuver and as arc chains during operation, and also as terminals in the insertion of fan-shaped heads which extend self-constrained as indicated in FIG. 7.

In FIGS. 13 and 12 there is indicated schematically a circular covering, the beams of which extend horizontally together with their own panelling and with the complementary walls for closing the roof and the base.

FIG. 15 shows in a non limitative form a covering in which the rigid head connection is connected to a cart at the extremity thereof, which cart runs on guides located on fixed structures, and which permit the insertion of mobile intermediate structures, by reason of which the beams assume the characteristics of continuous beams. The coverings may be further characterized by semiknots directly affixed on panels functioning as runners which assume the shape and rigidity wanted with the insertion into the opposite halfbeam.

FIG. 14 shows by way of non-limitative example, an embodiment being in fact applicable to all retractable coverings, which uses large rigid panels, hinged in book-fashion, which the beams support and control according to the specific requirements in the mechanized closing of hatches.

FIGS. 16, 18, 19, 17 and 20 illustrate in a non-limitative manner realizations of structural metalmechanic character; FIGS. 21, 22 and 23 illustrate a retractable minibeam formed of deformable material (rubber, plastic, etc.) used for stiffening and supporting solar panels.

With FIG. 16 there is indicated an autoladder, totally motorized, composed of two beams joined by steps, potentiated by handrails of synchronized movement, rotating on a column fixed on the flat bed of a truck, all the unit being retractable to the position shown in FIG. 18.

FIG. 19 schematically shows an assembly in which the beams are the mechanic means for the recovery and haulage of lifeboats and/or other utilities.

FIG. 17 indicates the scheme of a shell-shaped assembly, the resistant structure of which identify themselves with the assemblying support boxes and with the sections containing the free interchained meshes; of a group of beams emerging on the center synchronized in tower fashion, seen extended at D/1 and retracted at D/2, while other beams of single autoregulating functionality, indicated with D/3, emerge from the sides and insure the stability of the whole unit on any support surface. Complementary means render the whole unit functional even when it is immersed.

FIG. 20 indicates a minimum combination of three beams, of controlled and/or automatic automic functionality, forming an emerging thrust structure regulable in intensity and direction, alimented by an hydraulic motor, in the function of a stabilizing element of a pontoon. To permit an increase in length higher than the normal, the beams are alimented with new chains of meshes until there is reached the capacity of work and resistance dimensionally disposed for in the planning.

FIG. 21 is a characteristic sectional view of half beams in which rigid sections alternate themselves to elastic sections which, by effect of the rotation evidenced in FIG. 22, swell up as in FIG. 23 and constrain themselves in the cavity of the opposed half beam which stiffens a solar panel of automatic retraction for functionality and safety.

Although only some embodiments of the invention have been described in order to illustrate same in a non-limitative manner, it is to be understood that many variations, all falling within the parview of the present invention, can be arrived to by one skilled in the art in the light of the present description, all said variations being construed as falling within the scope of the present invention.

What is claimed is:

1. A retractable beam comprising a pair of beam chains each including a plurality of component elements pivotally mounted to each other, each component element including interlocking joint means extending therefrom, said pair of beam chains being juxtaposable with each other causing said interlocking joint means of said component elements of said pair of beam chains to interlock with each other forming a rigid beam structure, said interlocking joint means comprising at least one jaw extending from at least one of said component element on one of said beam chains, said jaw being slightly elastically and resiliently movable with respect to said one component element, and a pin connected to at least one of said component elements on said other of said beam chains engageable with said jaw to form a substantially rigid connection between said component elements of said one and said other beam chains, said jaw being abutable against said pin to elastically deform said jaw and permit engagement between said jaw and said pin.

2. A retractable beam according to claim 1, wherein said component elements of one of said pair of beam chains is juxtaposed with said component elements of the other of said pair of beam chains so that the mid-portion of said one component element is adjacent the end portion of the other of said component element.

3. A retractable beam according to claim 1, further including a support box into which said beam chains are inserted for guiding said beam chains into juxtaposition with each other and interlocking said interlocking joint means.

* * * * *